United States Patent [19]

Nickel

[11] Patent Number: 4,635,572

[45] Date of Patent: Jan. 13, 1987

[54] DESULFURIZING OF FOSSILE FUELS

[75] Inventor: Klaus-Dietrich Nickel, Frankfurt am Main, Fed. Rep. of Germany

[73] Assignee: Kasa-Technoplan GmbH, Frankfurt, Fed. Rep. of Germany

[21] Appl. No.: 710,127

[22] Filed: Mar. 11, 1985

[30] Foreign Application Priority Data

Mar. 13, 1984 [DE] Fed. Rep. of Germany ..... 3409014
Mar. 13, 1984 [DE] Fed. Rep. of Germany ..... 3508650

[51] Int. Cl.[4] ..... F23B 7/00

[52] U.S. Cl. ..... 110/343; 110/232; 110/344; 110/345; 110/347

[58] Field of Search ..... 110/347, 342, 345, 232, 110/204, 343, 344; 236/15 E

[56] References Cited

U.S. PATENT DOCUMENTS 4,262,610 4/1981 Hein et al. ..... 110/342
4,450,777 5/1984 Wolfrum et al. ..... 110/342
4,547,351 10/1985 Im et al. ..... 110/345 X

*Primary Examiner*—Edward G. Favors
*Attorney, Agent, or Firm*—Toren, McGeady, Stanger, Goldberg & Kiel

[57] ABSTRACT

A process and devices with which the fused sulphur is removed from fossil fuels, preferably coke and petrocoke, ahead of the furnace or the like and is fused with an additive. In the combustion chamber, the additive with the fused sulphur is then sintered. The fuel is desulphurized at a temperature management controllable by an electronic process computer, at controllable residence times and pressure conditions in leading zones so that practically completely desulphurized fuel is burned in the combustion chamber. The sulphur components are removed with the additive via an ash removal plant. A combustion of the sulphur components of the fuel to $SO_2$ within the combustion chamber does not occur.

28 Claims, 2 Drawing Figures

DESULFURIZING OF FOSSILE FUELS

The present invention relates to a process and devices for attaining flue gases low in $SO_x$ in furnaces operated with finely divided carbon-containing fuels, particularly coal. In said process the sulphur contained in the fuel is fused with a finely divided additive, preferably limestone powder ($CaCO_3$) caustic lime powder (CaO) or calcium hydroxide powder ($Ca(OH)_2$) and the desulphurized fuel is subsequently burned in the combustion chamber and the additive particles loaded with the sulphur are sintered and removed with the ash.

Deleterious by-products of the combustion of fossil fuels are generally known. One of the principal deleterious substances is sulphur dioxide of which approximately 4 million tons per year are released into the air in the Federal Republic of Germany—according to present standards—power plants and industry being the main cause. Despite the greatest efforts—worldwide—no satisfactory progress has been made to date to control the harmful $SO_2$ emissions and to reduce them to a tolerable limit.

Fossil fuel coal contains sulphur either as a mineral accompanying substance, particularly in the form of pyrite ($FeS_2$), or as so-called organic sulphur. Elementary sulphur is scarcely found in mineral coal and not all in the Federal Republic of Germany. Organic sulphur is a constituent of the coal substance; the kind of its linkaged to coal is not yet exactly known. Corresponding to its occurrence in coal, the latter can be desulphurized by mechanical or chemical processes. These two processes are cumbersome, the chemical processes requiring particularly high investment and operating costs.

It is significant for the chemical desulphurization processes that coal is practically insoluble in conventional solvents and, therefore, it is not affected by selective reagents. Only "cracking" of the entire structure permits chemical action.

In order to reduce the amounts of $SO_x$ set free on burning fossil fuels on a large industrial scale, processes and plants for the desulphurization of flue gases or for the desulphurization of the fuels are primarily used and tested. However, all the measures known heretofore have resulted in a more or less severe increase of the energy prices since the required plants can be financed only in this manner.

The method in most widespread use is the desulphurization of the flue gases. Since the $SO_2$ formed during the combustion is removed in this case, the form of the original fusion of the sulphur with the fuel is not important. Wet-desulphurization plants in which calcium sulphate is formed from the preferred additives and the sulphur is fused to the calcium sulphate is in most widespread use. This kind of flue gas desulphurization increases the price for current by 1.9 Pfennig per kilowatt hour. This corresponds to a price increase of DM 50.- per ton of coal used.

Furthermore, the combustion chamber and the flue gas outlet of the boiler plant must consist of materials which are compatible with the $SO_2$ components contained in the flue gases. Therefore, when designing the boiler plant the increased price for these materials must be taken into account.

A number of pilot projects in which the flue gases are subjected to dry desulphurization before they leave the boiler outlet are known for the desulphurization of the flue gases in the boiler. They are based on the principle of adding sulphur-binding additives to the flue gases while still in the combustion chamber, i.e., particularly CaO (caustic lime powder), $Ca(OH)_2$ (calcium hydroxide powder) and $CaCO_3$ (limestone or lime powder) which result in fusing the sulphur content. The fusion of the sulphur content of the flue gas with the additive is based on the fact that calcium oxide reacts with $SO_2$ and the excess oxygen or with $SO_3$ to calcium sulphate, $$CaO + SO_2 + \tfrac{1}{2}O_2 \rightarrow CaSO_4 \quad (1)$$

calcium sulphate $= CaSO_4 \cdot 2H_2O$ $$CaO + SO_3 \rightarrow CaSO_4 \quad (2)$$

which accummulates in the ash. When calcium oxide is not used directly as the additive but calcium hydroxide or lime is used, then they must first decompose to $$Ca(OH)_2 \rightarrow CaO + H_2O \quad (3),$$

$$CaCO_3 \rightarrow CaO + CO_2 \quad (4).$$

Without discussing the reaction parameters of the reactions in greater detail it can be said that the efficiency of the desulphurization of flue gas in a boiler depends on a plurality of parameters and is extremely complex. Thus, for example, the type of coal, the partial pressure of the $SO_2$, the oxygen excess in the flue gas, the reaction temperature and the reaction temperature gradient, the residence time of the additive in the zone of flame, the turbulence in the combustion chamber, the place of injecting the additive into the combustion chamber, the velocity of the injected additive and other conditions—all of which are hardly or not at all controllable—are of great importance. Furthermore, it is also important that calcium sulphate formed splits off $SO_2$ again at temperatures above 1200° C. and that at temperatures above 1250° C. the CaO particles begin to sinter so that the surface of the additive is rendered inactive. Although this technique, which still is in the experimental stage, seems to be promising, it cannot yet be applied with good economical results.

Said technique of fusing $SO_2$ with additives in the boiler, which primarily relates to mineral coal as the fuel, must still be completed by a desulphurization process for lignite-operated furnaces for which the additives are mixed with the fuel prior to putting the fuel into the boiler. Although this latter technique has been successfully tested for lignite as a pilot project, their application to coal-operated furnaces has produced substantially lower degrees of desulphurization. The reason for this obviously lies in the higher flame temperature of mineral coal while the additives mixed with the fuel are subjected to the entire temperature spectrum of the flame and must pass through temperature ranges which can result in the decomposition of the sulphate already formed and in sintering of the additive surfaces.

A furnace in which additives are injected by means of air jets into the combustion chamber above the range of the flame have also been tested. The desulphurization was substantially improved as compared with mixing the fuel with additives ahead of the combustion chamber. However, these furnaces have prospects of good results only in small steam generators since the manner of injecting the additives into the combustion chamber, primarily in the case of large flue gas volumes, requires a very high mixing energy in order to attain proper mixing of the reactants. Furthermore, this mixing process occurs in the region of the boiler wherein with regard to the temperature and the residence time the reaction conditions for fusing the sulphur are not optimal.

Furthermore, deteriorated conditions are obtained in large-size boilers having several burners arranged side by side andn one above the other. Very complex flow patterns and temperature fields are thus obtained. The fact that for a reliable fusion of the $SO_2$ with the additive an optimal temperature/time history of the injected additive cannot be guaranteed should be decisive.

Therefore, it is the aim of the present invention to provide an inexpensive process and devices by means of which fossil fuels can be so desulphurized that during their combustion in the combustion chamber appreciable amounts of $SO_x$ can no longer form or produce harmful effects.

This aim is achieved in that the fuel and the additive are prepared in separate disintegration processes, that the disintegrated fuel is then mixed with newly prepared additive in an amount corresponding to the sulphur content of the disintegrated fuel, that the fuel-additive mixture is then transported by a heated-up transport gas under a controllable excess pressure—while maintaining the mixture—to a reactor designed as a leading zone, wherein the transport gas pressure drops suddenly and that in a low-oxygen atmosphere of inert gas within an adjustable temperature range above the boiling point of sulphur the residence time of the mixture is adapted to the proceeding thermodynamic and reaction—kinetic sulphur transfer process, in which the sulphur is expelled from the fuel and the additives are loaded with the sulphur vapour and the gaseous sulphur compounds, whereupon the fuel substantially freed from sulphur and injected into the combustion chamber is burned at a temperature at which the loading of the likewise injected additive particles with the sulphur vapour and the gaseous sulphur compounds is maintained up to the sintering process.

By means of the process characterized in the claims, it is possible to expel the sulphur contained in the fuel even ahead of the combustion chamber.

The disintegration of the fuel, for example, of the coal, is carried out in an inert gas atmosphere in a disintegrator, preferably according to DE-OS No. 30 34 849.3, in order to avoid spontaneous ignition of the fuel during its comminution.

The disintegration of the additive is also carried out in a disintegrator but in an independent disintegration process in an atmosphere of standard air or oxygen with the result that oxygen accumulates on the additive particles. The oxygen promotes the subsequent loading of the additive particles with the sulphur vapour and the gaseous sulphur compounds expelled from the fuel.

The fuels and additives prepared in separate disintegration processes are then mixed with each other, the finely divided fuel being mixed with newly prepared fine-grained additive (but not with stored, aged additive powder under any circumstances).

The mixture of finely divided fuel and highly active additive is then transported by an inert transport gas heated to approximately 500° to 600° C. to a reactor designed as a leading zone, said mixture being transported under a controllable excess pressure of between 4 and 6 bars. This excess pressure is required to prevent degassing of the fuel in the transport line, whose length depends on the structural conditions available ahead of the combustion chamber. For safety reasons the disintegration of the fuel and of the additive to fine dust is usually not carried out in the vicinity of the combustion chamber.

When the transport line, which is under pressure, discharges into the reactor the pressure of the hot transport gas (adjustable) is abruptly released by the larger cross section of the reaction chamber and the pressure drop is utilized, via a control device, for an eddy zone in whose agglomeration—inhibiting and agglomeration—dissolving turbulences, temperature and residence time are so adjustable that the thermo-dynamic and reactionkinetic sulphur transfer from the fuel to the additive can be adapted to the chemo-physical properties of the fuel-additive mixture in each case.

Under these conditions, which can be controlled with an electronic process computer, a sulphur transfer from the powdered fuel heated in the leading zone to the given reaction temperature to the highly active, reactive additive likewise heated to the given reaction temperature proceeds due to the fact that because of abrupt pressure drop of the transport gas on being discharged into the reactor of the leading zone the evaporation temperature of the sulphur and the reaction temperature of the gaseous sulphur compounds also are abruptly reduced so that the sulphur is expelled from the fine fuel particles by almost explosive evaporation or the gaseous sulphur compounds are suddenly split off and absorbed by the more reactive additive while giving off oxygen into the eddy zone. The pressure in the eddy zone of the reactor is predetermined by the process control as 0.25 bar for this process procedure. A liberation of volatile component is within limits, which do not negatively influence the characteristics of the combustion.

The fine-grained solid fuel which has been substantially freed from its sulphur content is fed, together with its already liberated volatile components and the sulphur-loaded additive particles, via a short conveying track behind the leading zone to the burner, where it is enriched with combustion air and injected into the combustion chamber. Because of volatile components already liberated the final combustion of the fuel begins immediately after the burner nozzle. Therefore, with specific safety precautions supporting burners can be dispensed with.

Because of the injection of the very fine-grained additive particles which had already been heated to a temperature of between 500° and 600° C. in the leading zone, into the hot zone of flame of the combustion chamber which begins immediately after the injection nozzle the additive is almost abruptly sintered and thus "sealed" and passed to the ash together with the incombustible ballast materials of the fuel. For this procedure of the process the combustion temperature must be kept below 1850° C. but above 1250° C. in order to assure a fusion of the sulphur with the additive by the shock-sintering, but the cleavage of the sulphur molecules into individual sulphur atoms by the thermal energy—which can occur explosively—is prevented prior to sintering. By splitting the sulphur molecules the linkage to the additive is lost by spontaneous repulsion reaction. In the lowered tempered flue gas zone sulphur molecules can be built up again and $SO_2$ can be formed by reaction with the residual oxygen contained in the flue gas. This kind of emission of flue gases loaded with deleterious substances is avoided by the process according to the present invention and by the electronically process-controlled plant technique applied in association therewith.

By means of the novel process sulphur compounds which are gaseous or at least gaeous at the adjustable temperature, $H_2S$ or organic sulphur compounds can be transferred to an additive. It is important that coking of the fuel, i.e, an unintended complete degassing, can be prevented even ahead of the combustion chamber by controlling the pressure and the temperature in the leading zone.

Since the solid matter additive per se is not combustible, it can retain evaporated sulphur or gaseous sulphur compounds at the given combustion temperature spectrum because of its special reactivity so that desorption does not occur. It thus is an advantage that burner, stack and flue gas outlet may consist of a material of a lower quality since they are no longer exposed to the corrosive $SO_2$ influence as heretofore.

The mixture of coal or fuel particles, which have not been degassed but have been freed from sulphur components, and additive particles with the fused sulphur passes into the combustion chamber in a properly preheated state and does not remove from the flame cone as much thermal energy as is removed by mixtures of coal particles and additive particles injected when cold.

According to the present invention it is possible to attain an almost superior desulphurization of fossil fuels ahead of the burner. Under special conditions a residual desulphurization of the fuel can also occur in the combustion chamber itself.

Particularly good results are obtained when highly active sulphur-binding additives prepared by means of a turbo-disintegration process are used.

The additives must be quantitatively adjusted to the fuel used in each case. Good results are usually obtained when the fuel is mixed with newly prepared highly active additive, preferably limestone powder or caustic lime powder (50% thereof having a particle size below 30$\mu$) in an amount of at least four times the sulphur content of the fuel.

According to the present invention coal prepared in a turbo-disintegration process can be used as fuel.

Expelling the sulphur from the fuel and the intensive reactions between the expelled sulphur and the additives are promoted according to the present invention in that the sulphur transfer process takes place in an eddy zone whose turbulences form optimal reaction zone.

The device for attaining flue gases low in $SO_2$ in the operation of furnaces for carrying out the process according to the present invention comprising a device for injecting mixtures of fuels and finely divided additive particles into the combustion chamber and with an ash removal plant by means of which the sintered additive particles loaded with the sulphur are removed along with the ash has a pressure transfer vessel designed as an intermediate storage tank for an intimate mixture of fuel particles and additive particles prepared in separate disintegration processes. Said pressure transfer vessel is connected to a line for compressed, heated inert transport gas on the one hand and connected on the other via means for loading this transport gas with the mixture of fuel and additive particles via a further transport line to a leading zone which can be heated to a temperature of 500° to 600° C. for evaporating the sulphur. In this leading zone the pressure drops abruptly due to the enlargement of the cross section between the transport line and the leading zone. Because of this and since the residence time of the mixture in the eddy zone is controllable within the leading zone by damper and reversing means and/or by screening plates, practically any fuel can be desulphurized according to the present invention.

The temperature within the leading zone must be adjustable to above the equilibrium temperature of sulphur and its vapour, preferably between 500° and 600° C.

Further favourable embodiments of the plant are evident from the claims.

All the control valves, mixing valves, dosing and damping devices can be operated electrically as well as pneumatically or hydraulically or via a process computer, which can control the entire process procedure in association with an $SO_2$-measuring device installed in the flue gas outlet—when required also in association with a thermometer installed in the leading zone.

The device according to the present invention permits an optimal desulphurization of the fuel without causing complete degassing ahead of the combustion chamber. According to the present invention the parameters for the orderly procedure of the desulphurization process can be optimally adjusted by many control and adjusting means corresponding to the coal. Therefore, according to the present invention there are provided suitable measuring devices, evaluation circuits and control devices with the aid of which the reaction temperature in the leading zone and in the reactors as well as the pressure can be optimally adjusted.

Practical examples of furnaces according to the present invention will be explained hereafter with reference to the drawings.

Figure 1:
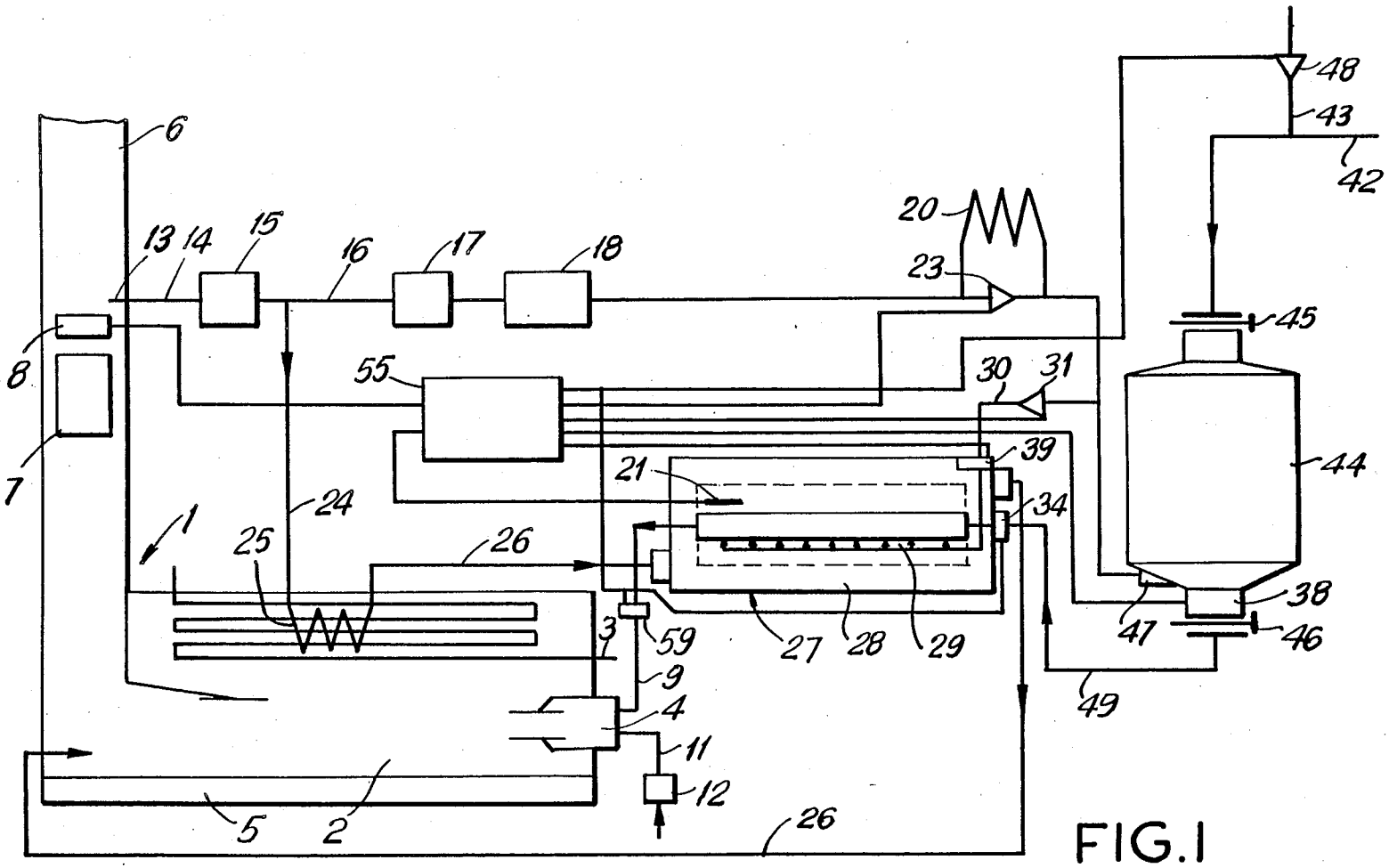
FIG. 1 shows a basic process flow diagram.

FIG. 1 shows diagrammatically a furnace 1. A combustion chamber 2 and a flue gas outlet 6 thereof are shown in a simplified manner. For example, an evaporation pipe line 3 is indicated above the combustion chamber 2.

A burner device 4 is provided with combustion air in the usual manner via a combustion air feed line 11 and a conveying blower 12.

An ash removing plant 5 which is known per se is indicated diagrammatically below the combustion chamber 2.

A dust separator 7 and a conventional $SO_2$-measuring device 8 are provided in the flue gas outlet 6.

The required fuel in the form of gas and fuel particles is fed to the burner device 4 from a leading zone 27 via a transport gas line 9. In said leading zone the fused sulphur is removed from finely divided, preferably solid fossil fuels. In the practical example shown the leading zone 27 has a double wall 28 which is connected to a flue gas extractor 13 in the flue gas outlet 6 via a heating gas line 26 and a heat exchanger 25 in the combustion chamber 2 as well as via a further heating gas line 24. Inert flue gas is removed behind the dust separator 7 by means of a blower 15 via the flue gas extractor 13. Behind the blower 15 the flue gas line is divided into said heating gas line 24 and a transport gas line 16, which will be described hereafter.

In the heat exchanger 25 the heating gas portion of the removed amount of flue gas is heated up in order to heat the leading zone 27 to a desired temperature. In the leading zone there is normally maintained an optimal pressure and a sufficiently high temperature at which the sulphur components are expelled from the fuel without degassing the fuel, for example, the coal. However, depending on the size of the leading zone 27 and the amount of the additive used for taking up the sulphur components expelled from the fuel the temperature of the leading zone is kept between 500° and 600° C., i.e., above the boiling temperature of the sulphur. The temperature required in each case is adjusted by means of temperature regulators which are known per se and are not described in detail here. A fluidized bed 29 which is known per se and is connected to the transport gas line 16 via an inlet line 30 and a control valve 31 is disposed within the leading zone 27 and the reaction space separated therefrom by the double wall 28. The amount of flue gas drawn off by the blower 15 passes via the transport gas line 16 and a suction filter 17 to a compressor 18 and then via a control valve 23, the control valve 31 into the inlet line 30 and via a branch line to a transport gas inlet 47 at a pressure transfer vessel 44.

A heat exchanger 20 for the transport gas, which can be disposed in the combustion chamber 2 like the heat exchanger 25, is provided parallel to the control valve 23. The temperature of the transport gas, which is branched off for the fluidized bed 29 and also passes to the transport gas inlet 47, can be adjusted and controlled by means of the control valve 23 in a manner known per se. Care must be taken that the flue gases which are removed from the flue gas outlet and are free from dust have a substantial initial temperature. The transport gas thus does not have to be heated up from the relatively cold ambient temperature.

For the two purposes it is advantageous when the temperature of the transport gas is adjusted to a value of between 500° and 600° C. The temperature is adjusted, for example, with the aid of a process computer 55 described hereafter.

The gases passing through the inlet line 30 into the leading zone 27 are used in a manner known per se for the formation of a fluidized bed 29 whose intensity can be influenced by the control valve 31.

Futhermore, a further dosing device 39 which is known per se can be provided for additionally influencing the fluidized bed within the leading zone 27, as for example, the pressure within said zone.

The intimately mixed fuel and additive particles are fed to the leading zone 27 via a transport gas line 49 from a pressure transfer vessel 44, which is known per se and has an inlet slide 45 and outlet slide 46 for reliably shutting off. Said pressure transfer vessel is in turn connected via a conveying line 42 to a device for mixing coal dust and additive particles which is known per se and is not described in connection with the present invention. When required, additive can be additionally fed into the conveying line 42 via an auxiliary line 43 having a corresponding control valve 48.

It is advantageous when a damper 38 is provided ahead of the outlet slide 46.

All the control valves 23,31,48 but also the damper 38 can be influenced by the $SO_2$-measuring device 8 in the flue gas outlet 6 via an electronic process computer 55 and when required by the temperature in the leading zone so that the reaction in the leading zone, i.e., the desulphurization of the fuel and the fusion of the sulphur components with the additive particles proceed completely under the control of the electronic process computer 55.

For example, if the $SO_2$ values increase, more additive can be added to the mixture in the line 42 via the control valve 48. The temperature can be influenced by a thermometer 21 installed, for example, in the leading zone 27, via the electronic process computer 55 in that the temperature acts on the control devices 23 and/or 31. The electronic process computer 55 is also in operative connection with the dosing devices 38,39 in order to influence the residence time in the leading zone 27. Without changing the concept of the present invention the control and adjustment of the feul desulphurization ahead of the combustion chamber 2 can also be carried out by other control means or manually. A dosing device 34 and a throttle valve 59 which also are conected to the electronic process computer 55 are provided in front of and behind the leading zone 27. With these parts the residence time in the leading zone 27 as well as the internal pressure can be adjusted precisely.

A basic process flow diagram for illustrating the novel process for desulphurizing fuel and a device suitable for this purpose are shown in FIG. 1. It is important that short lines are provided between the leading zone 27 and the burner device 4 so that the fuel and the additive do not cool down again. It is evident from the flow diagram of FIG. 1 that with relatively simple means the novel fuel desulphurization process can be applied with advantage to new furnaces but also to existing furnaces 1 with the aid of the device described. In all the cases of application the desulphurization of the fuel particles ahead of the burner device 4 is substantial to complete. The $SO_2$ emissions in the combustion chamber and in the flue gas outlet 6 as well as the resulting pollutions and destructions of these parts of the furnace are reduced to a minimum or avoided altogether. No $SO_2$ is released into the atmosphere.

A preferred practical example of a furnace according to the present invention will be explained hereafter with reference to a process flow diagram according to FIG. 2.

Figure 2:
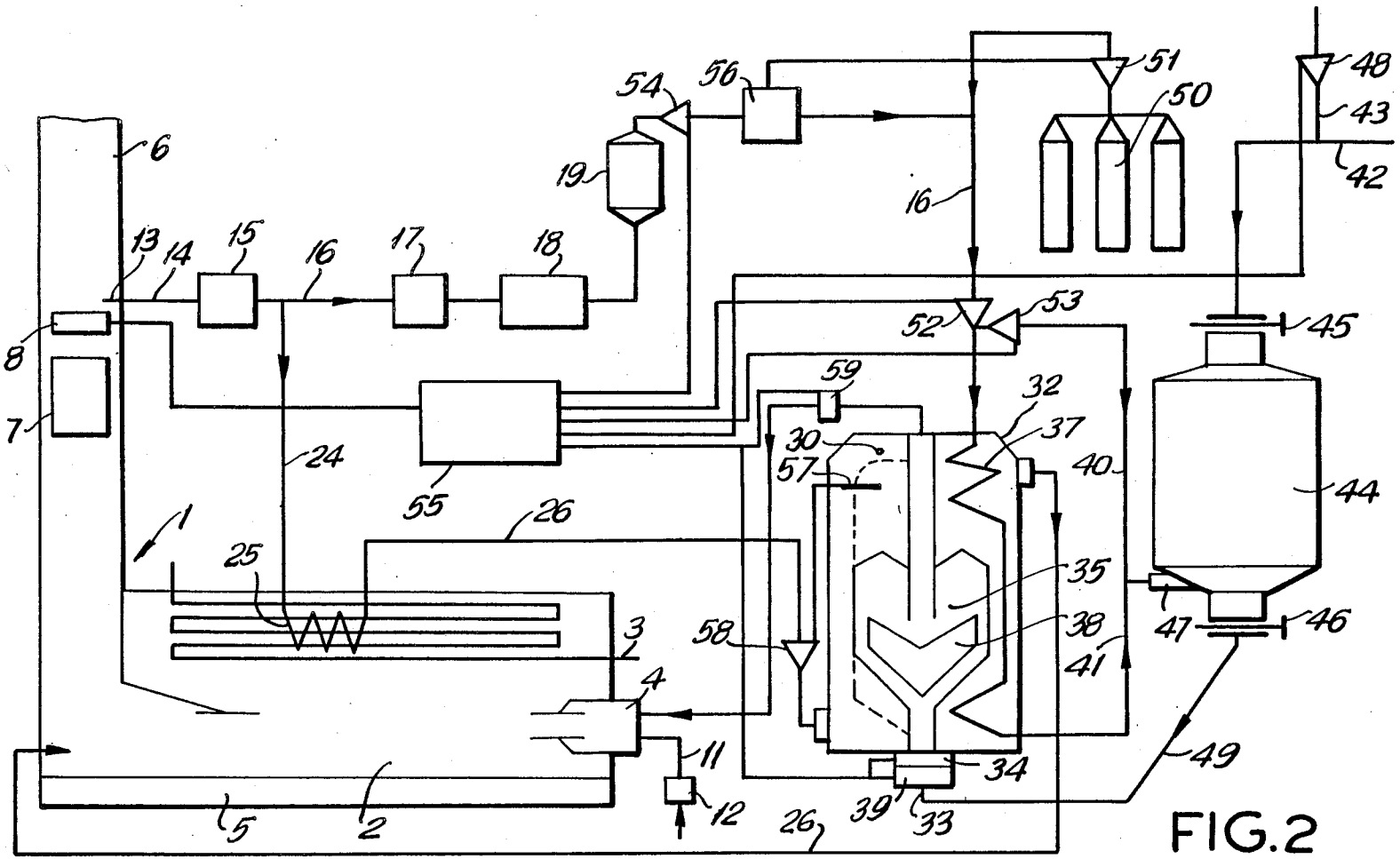
FIG. 2 shows a flow diagram of a preferred practical example of the present invention.

To the extent that the same parts of the device are used in a furnace according to FIG. 2 as in that of FIG. 1 and the corresponding reactions or the like are the same, reference is made to the preceding description.

The present practical example differs from the first one in that in the transport gas line 16 behind the compressor 18 there is provided a storage tank 19 for compressed transport gas. A control valve 54 for the transport gas is connected to the outlet of said storage tank. An oxygen measuring device 56 can be disposed in the portion of the transport gas line 16 connected to the control valve 54. When the oxygen content in the transport gas line 16 is too high the oxygen measuring device 16 turns on and off an inert gas source 50 via a control valve 51 in order to feed more or less inert gas into the transport gas line 16. This assures that the mixture of fuel and additive particles cannot ignite ahead of or in the leading zone.

Behind a further control valve 52 the transport gas line 16 branches off. A bypass line 41 runs via a heating device, wherein the transport gas is heated.

Via a mixing valve 53 a line 40 for normally tempered transport gas branches off and joins again with the bypass line 41 ahead of the transport gas inlet 43 leading into the pressure transfer vessel 44. The control valve 52 and the mixing valve 53 can be actuated by the electronic process computer 55, which can be influenced by the $SO_2$-measuring device, in order to adjust the temperature of the transport gas for the intimately mixed fuel and additive particles. The heating device 37 can be disposed in the combustion chamber 2. In the present practical example said heating device is installed in a double wall 36 of a fluidized bed reactor 32. The double wall 36 is heated via the heating gas line 26, wherein a regulating valve 58 is disposed. Said regulating valve is controllable by a thermometer 57 in the fluidized bed reactor 32.

The temperature in the fluidized bed reactor is adjusted as a function of the fuel used in each case. Fundamentally the temperature must be adjusted sufficiently high in order to assure that the sulphur components escape from the fuel particles. It is advantageous when the temperature within the fluidized bed reactor lies above the boiling point of sulphur. Quick and good results can be attained when the temperature within the fluidized bed reactor is maintained between 500° and 600° C.

An inlet 33 of the fluidized bed reactor 32 is connected to the outlet of the pressure transfer vessel 44 via a dosing device 34 connected to the process computer 55 and/or via a dosing device 39 and via the transport gas line 49.

A damper and reversing means 38, behind which a fluidized bed 35 is formed by the transport gas loaded with the intimately mixed fuel and additive particles, is disposed within the temperature-controlled fluidized bed reactor 32. In the fluidized bed the sulphur components are expelled from the fuel and taken up by the additive. The residence time thus required can be adjusted via the dosing device 34 and/or via the dosing device 39 but also with the aid of a throttle valve 59 behind the leading zone 27, for example, by the electronic process computer 55. On account of the temperature control, the abruptly dropping pressure and the adjustable residence time the additive is loaded with the sulphur components. In case that the sulphur components expelled from the fuel are not taken up by the additive to the required extent, $SO_2$ components would form during the combustion in the boiler room and this would be shown by the $SO_2$-measuring device. The latter device would then indicate that more additive powder is to be fed via the control valve 48 into the line 42, that the residence time in the fluidized bed reactor is to be extended and that the reaction temperature is to be increased or that the differential pressure between the transport line 49 and the leading zone 27 is to be changed. An additional amount of additive particles can be fed via an auxiliary line 43 and via a control valve 48 into the transport line 42 for the intimately mixed fuel and additive particles. In the practical example shown the control valve 48 is also connected to the electronic process computer 55 so that the excess of additive particles required for the desulphurization can always be assured in the mixture. It is advantageous when the amount of additive particles available for fusing the sulphur components is at least four times the amount of sulphur in the fuel.

Without changing the concept of the present invention the furnaces shown in the FIGS. 1 and 2 can also be combined if the fuel used requires that a residual desulphurization must be carried out in a reaction zone behind the fluidized bed reactor 32 before a detrimental combustion of the sulphur to $SO_2$ occurs in the combustion chamber 2. It is very advantageous when coal dust particles, which have been prepared form coal, for example, by means of the turbo-disintegration process with impact rates higher than 100 m per second, are used and when 50% of said coal dust particles have a particle size lower than 40$\mu$. Particularly good results are attained when the coal particles are prepared at impact rates exceeding 200 m per second. With regard to expelling the sulphur components at the specified temperature a "highly active" coal fuel is obtained in this manner. The surfaces of the coal particles are not compacted, as for example, in the case of a comminution of the coal in ball mills, but they are "broken up" to prepare them for an effective desulphurization. The temperature control practised in the leading zones according to the present invention causes merely the expulsion of the sulphur components but does not degas. The fuel particles passed over the short stretches between the leading zones and the burner space into the combustion chamber 2 thus are not coked but are perfect fuel freed from sulphur.

Highly active sulphur-binding additives, for example, limestone powder, caustic lime powder or calcium hydroxide powder are also obtained by preparing these additives by means of the turbo-disintegration process at high impact rates of up to and exceeding 200 m per second. 50% of the particle sizes obtained in this preparation are above 30$\mu$. The additive particles do not have a compacted surface as in the case of a comminution in ball mills, but the additive is highly active and at the temperature applied and during the adjustable residence times it can be saturated with the expelled sulphur components.

The device according to the present invention can be adjusted to different fuels. The amount of fuel particles and additive particles in the mixture can be varied and the temperature control as well as the residence times in the leading zones can be optimally adapted to the fuel and its sulphur content. By removing the transport gas from the flue gas outlet 6 gas low in oxygen is available for pneumatic conveying. The mixture cannot ignite. If the oxygen content in the transport gas would nevertheless exceed the values to be maintained for safety reasons, then inert gas can be added additionally to the transport gas removed from the flue gas outlet.

Before the fuel thus treated burns in the combustion chamber practically all its sulphur has been removed so that $SO_2$ cannot be formed in the combustion chamber.

The following facts quite generally apply to the two practical examples of the present invention:

The fuel and the additive are prepared in separate disintegration processes. The preparation and comminution of the fuel is carried out in an atmosphere of inert gas, primarily in order to prevent spontaneous ignition of the fuel. However, the preparation of the additives is carried out in an atmosphere of standard air or oxygen in which oxygen can add on to the additive particles and contributes substantially to the activation of the additive particles and promotes the fusion of the sulphur component with the additive.

The embodiments of the invention in which an exclusive property or privilege is claimed are defined as follows:

1. A process for attaining flue gases low in $SO_x$ in furnaces operated with finely divided carbon-containing fuels containing sulphur, such as coal, in which process the sulphur contained in the fuel is fused with a finely divided additive, selected from the group consisting of limestone powder ($CaCO_3$), caustic lime powder ($CaO$) and calcium hydroxide powder ($Ca(OH_2)$) and the desulphurized fuel is subsequently burned in a combustion chamber and the additive particles loaded with the sulphur are sintered and removed with the ash, wherein the improvement comprises preparing the fuel and the additive in separate disintegration processes, mixing the disintegrated fuels with newly prepared additive in an amount corresponding to the sulphur content of the fuel, transporting the fuel-additive mixture in a heated-up inert transport gas under a controllable excess pressure—while maintaining the mixture—to a reactor designed as a leading zone, abruptly dropping the transport gas pressure as the mixture enters the leading zone in a low-oxygen atmosphere of inert gas within an adjustable temperature range above the boiling point of sulphur, adapting the residence time of the mixture and proceeding with a thermodynamic and reaction-kinetic sulphur transfer process, and expelling the sulphur from the fuel in the form of sulphur vapor and gaseous sulphur compounds and the additives are loaded with the sulphur vapour and the gaseous sulphur compounds, and injecting the fuel substantially freed from sulphur into the combustion chamber and burning the fuel at a temperature for sintering the loading of the injected additive particles with the sulphur vapour and the gaseous sulphur compounds.

2. A process according to claim 1, wherein preparing the highly active sulphur-binding additives by disintegrating the additives with the high rates of impact, in a turbo-disintegration technique with impact rates exceeding 100 m per second.

3. A process according to claim 1 or 2, wherein mixing the fuel with newly prepared additive, with 50% of particle size of the additive being less than 30 μm, in an amount of at least four times the sulphur content of the fuel.

4. A process according to claim 1 or 2, wherein using finely divided coal as the fuel and converting the coal into coal dust by a turbo-disintegration technique with impact rates exceeding 100 m per second and with 50% of said coal dust having a particle size below 40 μm.

5. A process according to the claim 1 or 2, wherein heating the leading zone to a temperature of between 500° and 600° C.

6. A process according to claims 1 or 2, wherein a boiler having a flue gas outlet is associated with the furnace, drawing inert flue gas free from dust from the flue gas outlet (6) of the boiler plant (1) for transporting the mixture of coal dust and finely divided additive and for heating the leading zone.

7. A process according to claim 6, wherein heating a partial amount of the transport-gas component of the amount of flue gas removed to a temperature of between 500° to 600° C. and mixing the partial amount with an amount of nonheated transport gas for controlling the temperature prior to assuming the transport function.

8. A process according to claim 7, wherein providing the transportgas component of the amount of flue gas removed with an excess pressure of between approximately 4 and 6 bars on assuming the transport function.

9. A process according to claim 8, wherein the leading zone being gas-tight and including at least one of a fluidized bed (29) and a fluidized-bed reactor (32) and constructing the fluidized bed by one of fluidizing the transport gas loaded with the mixture of coal dust and additive and injecting heated flue gas into the transport gas flow loaded with the coal dust-additive mixture.

10. A process according to the claims 1 or 2, wherein controlling the mixture ratio of coal dust and additive as a function of $SO_2$ measured in a flue gas outlet of the furnace.

11. A process according to the claims 1 or 2, wherein adding inert gas to the transport gas when its oxygen content is inadmissibly increased.

12. A process according to the claims 1 or 2, wherein effecting the combustion of the fuel in the combustion chamber at a temperature of between 1850° and 1250° C.

13. A process according to claim 8, wherein abruptly expelling the sulphur in the leading zone from the fuel with the drop of the transport gas pressure from approximately 4 to 6 bars to approximately 0.25 bar.

14. A process according to the claims 1 or 2, wherein abruptly sintering the additive particles loaded with the sulphur vapour and the gaseous sulphur compounds in the combustion chamber.

15. A device for attaining flue gases low in $SO_x$ in furnaces operated with finely divided carbon-containing fuels containing sulphur where the sulphur in the fuel is fused with a finely divided additive, comprising a combustion chamber having a flue gas outlet, means for injecting mixtures of fuels and finely divided additive particles into the combustion chamber, an ash removal plant for removing sintered additive particles loaded with ash and sulphur, wherein a pressure transfer vessel (44) for intermediate storage of an intimate mixture of fuel and additive particles obtained from separate disintegration processes, a line (16) for compressed heated inert transport gas is connected at one end to the flue gas outlet from said combustion chamber and at the other end to said pressure transfer vessel, outlet means (38, 46) from said pressure transfer vessel, means forming a leading zone (27), a transport line (49) connected at one end to said outlet means and at the other end to said leading zone, means associated with said leading zone for heating said leading zone to a temperature sufficient to evaporate the sulphur in the fuel, means for pressurizing the transport gas, said leading zone having a cross-sectional space forming an eddy zone for receiving the transport gas containing the fuel and additives with the cross-sectional area of the space being greater than the cross-sectional area within said transport line so that the transport gas experience a pressure drop on entering the cross-sectional space in said leading zone and means for controlling the residence time in the leading zone of the mixture of fuel and additives received from said transport line.

16. A device according to claim 15, wherein a flue gas line (14) is connected to said flue gas outlet, a blower (15) located in said flue gas line (14), a dust separator (7) within said combustion chamber adjacent said flue gas outlet, and a blower (15) located in said flue gas line (14).

17. A device according to claim 16, wherein said flue gas line (14) is branched downstream from said blower (15) into a heating gas line (24) and a transport gas line (16).

18. A device according to claim 17, wherein said heating zone includes a heating device (28), said heating gas line (24) connected to said heating device, a heat exchanger (25) located in said combustion chamber (2), and said heating gas line (24) connected to said heat exchanger (25) and arranged to conduct the heating gas flowing through the heat exchanger to said heating device (28).

19. A device according to claim 17, wherein a storage pressure tank (19) is located in said transport gas line (16), and a compressor (18) located in said transport gas line (16) upstream from said storage pressure tank.

20. A device according to claim 19, wherein said storage pressure tank (19) has an outlet, means connecting said outlet of said pressure of said storage pressure tank (19) to said pressure transfer vessel (44), and said means connecting said outlet and said pressure storage, said pressure transfer vessel includes a control valve (54) and a mixing valve (53) for adjusting the pressure and temperature of the transport gas, and said means further includes a bypass line (41) downstream from said mixing valve, a heating device located wtihin said means forming said leading zone (27), said bypass line (41) is connected to said heating device, and said bypass line is connected to said pressure transfer vessel (44) downstream from said heating device (37).

21. A device according to claim 20, wherein a storage pressure tank (50), a control valve (51) connected to said storage pressure tank (50), conduit means connecting said control valve (51) to said transport gas line (16).

22. A device according to claim 15, wherein said pressure transfer vessel (44) having an inlet, and means for locking the inlet and the outlet of said pressure transfer vessel (44).

23. A device according to claim 22, wherein said means for locking said inlet and outlet comprises an inlet slide (45) for said inlet and an outlet slide (46) for said outlet.

24. A device according to claim 15, wherein said means forming said leading zone (27) includes a fluidized-bed reactor (32) with impact and guide devices (35, 36) for said fluidized-bed reactor.

25. A device according to claim 15, wherein said means forming said leading zone includes a fluidized-bed (29), means for introducing flue gas into said fluid bed (29) and a controllable damping and dosing device (59/39) for transport gas located between said inlet ad said fluidized bed.

26. A device according to claim 24, wherein said fluidized-bed reactor (32) has a double wall, a heating gas line (24, 26) extending between said transport gas line (16) and said leading zone, and a heating device (37) located within said double wall for conducting the transport gas compartment through said double wall.

27. A device according to claim 21, wherein an oxygen measuring device (56) located in said transport gas line (16), and said oxygen measuring device (56) is connected to said control valve (51) for said storage pressure tank (50).

28. A device according to claim 15, wherein a $SO_2$-measuring device located in said flue gas outlet (6) of said combustion chamber, a thermometer (21) in said leading zone (27), an electronic process computer (55), a storage tank (19) in said gas transport line (16), said storage tank (19) having an outlet, a control valve (54) located at the outlet from said storage tank (19), said $SO_2$-measuring device and said thermometer (21) connected to said electronic process computer (55), a control valve (23) located in said transport gas line (16), an auxiliary line (43) connected to said pressure transfer vessel (44), a control valve (48) in said auxiliary line (43), a dosing device (34, 59) located at an inlet to and an outlet from said leading zone (27, 29, 32), a branch line (30) connecting transport gas line (16) to said leading zone (27) and a control valve (31) located within said branch line and damping and dosing devices (38, 39) in said branch line entering into said leading zone, and said electronic process computer (55) arranged to control said control valves.

* * * * *